US005832672A

United States Patent [19]

Griffiths et al.

[11] Patent Number: 5,832,672

[45] Date of Patent: Nov. 10, 1998

[54] BEACH BLANKET ANCHORING DEVICE

[76] Inventors: Scott Griffiths, 85 Stillwell Rd., Leonardo, N.J. 07737; Richard Davis, 93 Beacon Blvd., Keansburg, N.J. 07734

[21] Appl. No.: 829,365

[22] Filed: Mar. 31, 1997

[51] Int. Cl.[6] ..... E04D 1/34

[52] U.S. Cl. ..... 52/4; 52/5; 52/155; 52/162; 52/166; 52/163; 135/118; 135/119; 135/115; 5/417; 5/419

[58] Field of Search ..... 52/4, 5, 155–157, 52/162, 163, 166; 135/118, 119, 161, 115, 417–420; 24/72.5

[56] References Cited

U.S. PATENT DOCUMENTS

| | | | |
|---|---|---|---|
| 2,840,092 | 6/1958 | Hill | 135/119 X |
| 2,939,468 | 6/1960 | Boyce | 135/118 X |
| 4,914,767 | 4/1990 | Balikci et al. | 135/118 X |
| 5,245,715 | 9/1993 | Dinkins | 135/118 X |
| 5,396,743 | 3/1995 | Bellette | 135/118 X |

FOREIGN PATENT DOCUMENTS

| | | | |
|---|---|---|---|
| WO 91/10030 | 7/1991 | Switzerland | 52/4 |

*Primary Examiner*—Creighton Smith
*Assistant Examiner*—W. Glenn Edwards
*Attorney, Agent, or Firm*—Jean-Marc Zimmerman

[57] ABSTRACT

A device for anchoring a corner of a beach blanket or towel to the sand of a beach. The device includes a clamp removably attachable to the corner of the beach blanket or the towel for enabling the corner to be anchored to the sand of the beach, and a spike removably receivable in an eyelet defined on the clamp, for anchoring the clamp and thus the corner of the beach blanket or towel to the sand of the beach. The spike includes a locking mechanism for locking and unlocking the spike within the eyelet of the clamp.

14 Claims, 6 Drawing Sheets

BEACH BLANKET ANCHORING DEVICE

FIELD OF THE INVENTION

The present invention is directed generally to a device for anchoring sheet-like articles to soft ground surfaces. More specifically, the present invention is directed to a device for anchoring a beach blanket, towel or like article to the sand of a beach.

BACKGROUND OF THE INVENTION

The prior art is replete with various types of devices and apparatus for anchoring blankets, towels, and the like to the sand of a beach. The need for such devices is driven mainly by the problem of strong breezes and/or winds which are commonly encountered at beaches, especially ocean beaches. Strong breezes and winds can easily lift and move blankets and towels which are placed out and positioned on the beach without any method of anchoring. Even relatively mild breezes tend to blow and turn over the corners of such blankets and towels. Furthermore, traffic encountered at busy beaches is also problem since people walking by the blanket or towel tend to disturb the placement of the blanket or towel. In either circumstance, the beach-goer must repeatedly reposition the blanket or towel over the course of a stay at the beach.

Examples of such prior art devices and apparatus can be found in the following patents:

U.S. Pat. No. 4,927,118 issued to Pierorazio on May 22, 1990 discloses a device for retaining a beach towel or the like in place on a beach. The device consists of a receptacle having an open portion for receiving sand or the like therein. The sand applies a downward force which weighs the device down thereby retaining it in place. Means are provided on the device for removably securing the towel in place;

U.S. Pat. No. 5,101,525 issued to Ippolito on Apr. 7, 1992 discloses a stake assembly used in conjunction with a blanket fitted with eyelets. The stake assembly consists of a short member for use on a lawn and a sleeve member which is added to the short member for use on a beach. A stake assembly is received in each eyelet to anchor the blanket to a lawn or a beach;

U.S. Pat. No. 5,116,014 issued to Slavens et al. on May 26, 1992 discloses a beach towel anchoring device which consists of a unitary housing formed with a planar top surface and a partially planar bottom surface. The bottom surface includes an arcuate projection defining a forward portion for positioning the same into the sand of a beach. A resiliently-biased tongue member emerges from the top surface thereof and extends across a bore defined through the device, the tongue member being used in conjunction with the bore for securing a towel thereto;

U.S. Pat. No. 5,294,083 issued to Roth on Mar. 15, 1994, discloses a combined drink holder and beach blanket holder. The holder consists of a stake which is inserted into the sand. A hollow drink holder is mounted on top of the stake. A hook member extending from the stake is provided for holding down an edge of a blanket lying on the sand; and U.S. Pat. No. 5,390,890 issued to Ferguson et al. on Feb. 21, 1995 discloses a beach blanket retaining device consisting of a pointed base spike member which is driven into the sand of a beach. The base spike has an upper platform which includes a clamping member for securing a blanket thereto.

Most of the devices just described suffer from several drawbacks. First, they are somewhat difficult to attach to a blanket or towel. Second, they are relatively easy to displace once they are positioned into the sand of a beach, and thus the blanket or towel to which they are attached is easily disturbed. Finally, they are relatively expensive to manufacture. Accordingly, there exists a need for a blanket/towel anchoring device which is easy to attach to a blanket or towel, which is more resistant to being disturbed once it is positioned, and which is less expensive to manufacture than prior art devices.

SUMMARY

In accordance with the present invention, there is provided a device for anchoring a corner of a cover, such as a beach blanket, to an unpaved ground surface, comprising clamp means which are removably attachable to a corner of the cover for enabling the corner to be anchored to the ground surface, the clamp means including an eyelet. The device further comprises spike means which are removably receivable in the eyelet for anchoring a corner of the cover to the ground surface.

One aspect of the subject device comprises lock means provided on the spike means for preventing inadvertent withdrawal of the spike means from the eyelet. Another aspect of the device comprises barb means on the spike means for preventing inadvertent removal of the spike means from the ground surface. In practice, the device of the present invention can be used at each corner of the cover.

BRIEF DESCRIPTION OF THE DRAWINGS

A more complete understanding of the present invention may be obtained from consideration of the following description in conjunction with the drawings in which:

FIG. 1 is a perspective view depicting the anchoring device of the present invention at each corner of a cover or the like;

DETAILED DESCRIPTION OF THE INVENTION

Figure 1:
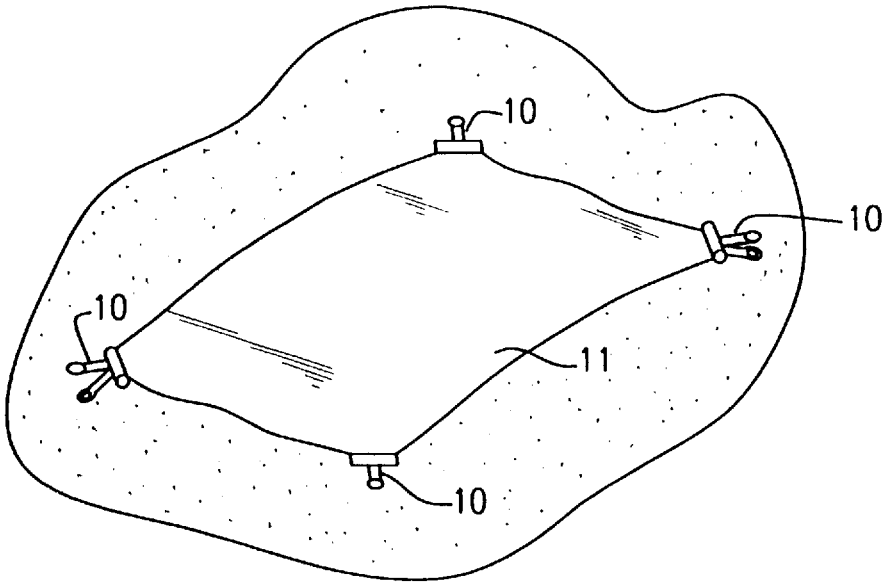
Figure 3A:
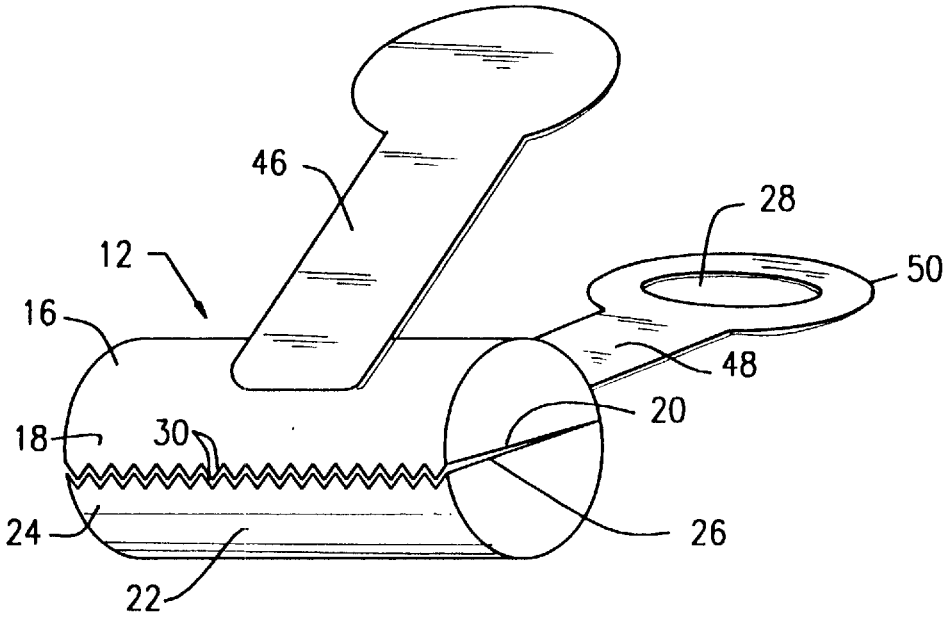
FIG. 3A is a perspective view of the clamp portion of the anchoring device shown in FIG. 2.

Referring to FIG. 1, the device 10 of the present invention is used to anchor a beach blanket, towel or other like ground covering article to an unpaved ground surface such as the sand of a beach. It is contemplated that, preferably, four such devices 10 will be utilized, one at each respective corner of a beach blanket 11, to be anchored. Being thus secured, breezes and winds will not blow and turn over the comers of the blanket 11 or easily lift and move the blanket 11 out of position on the beach. Furthermore, traffic encountered at the beach will not substantially disturb the placement of the blanket 11. Accordingly, a beach-goer utilizing the device of the present invention as shown in FIG. 1 will not have to repeatedly reposition the blanket 11 over the course of a stay at the beach.

Figure 2:
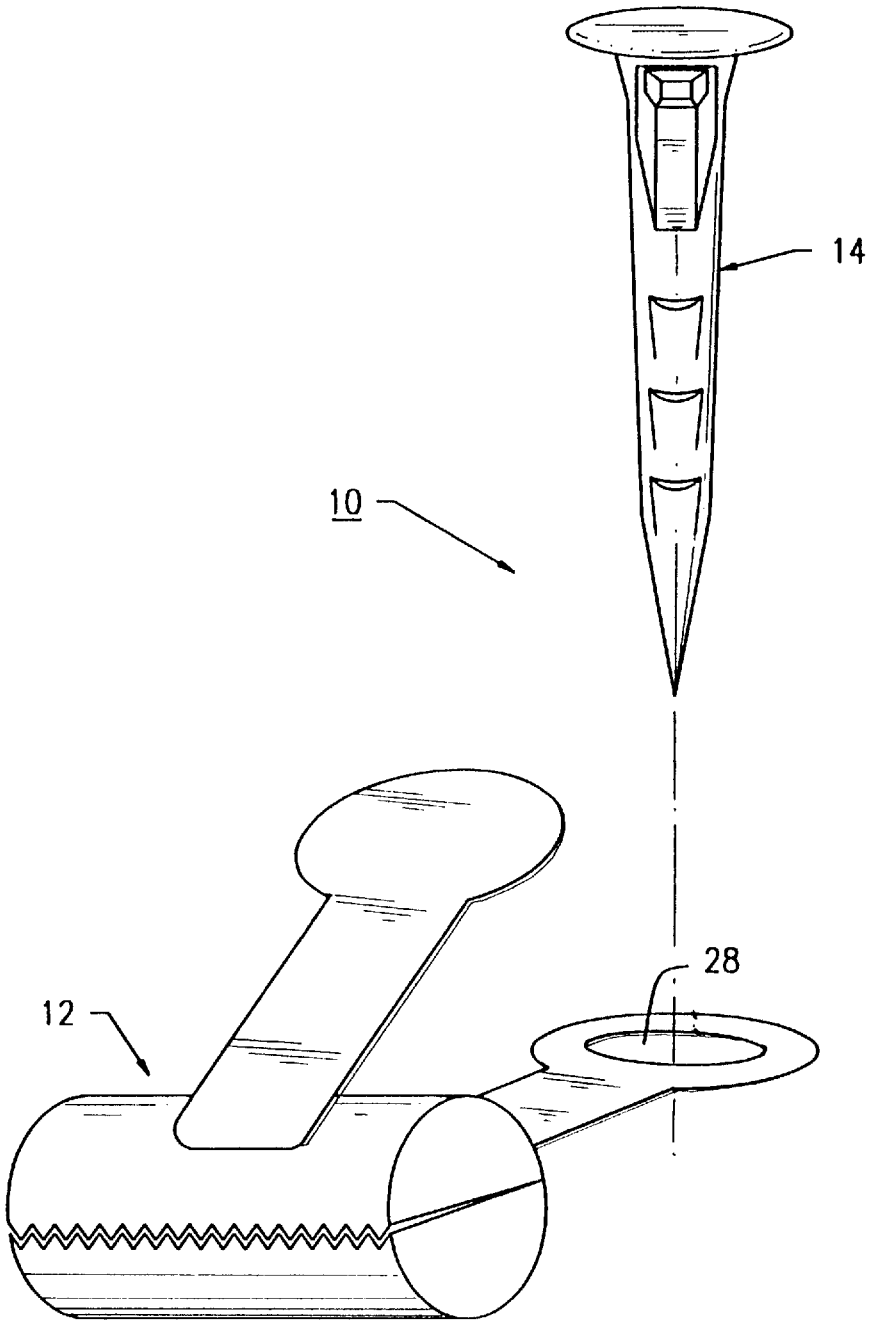
FIG. 2 is a perspective view of one of the anchoring devices of the present invention shown in FIG. 1.
Figure 3B:
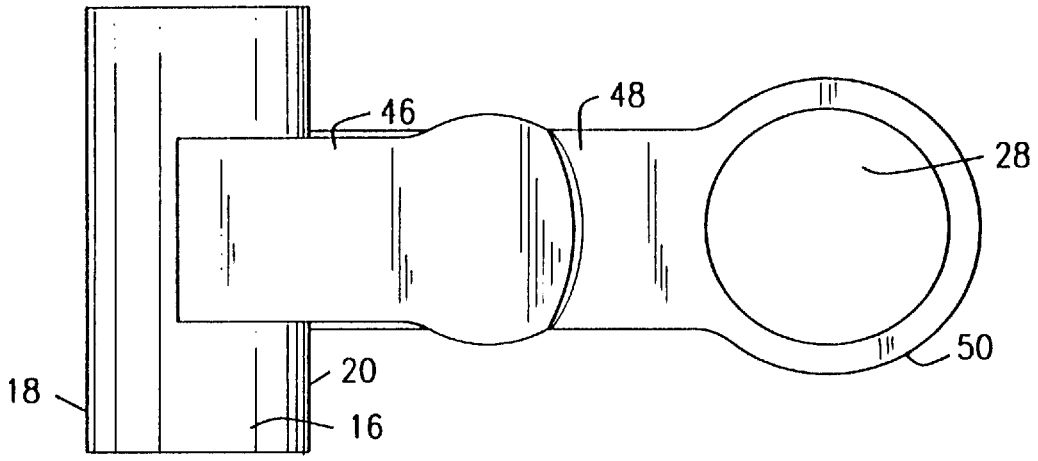
FIG. 3B is a top plan view of the clamp portion of the anchoring device shown in FIG. 2.
Figure 3C:
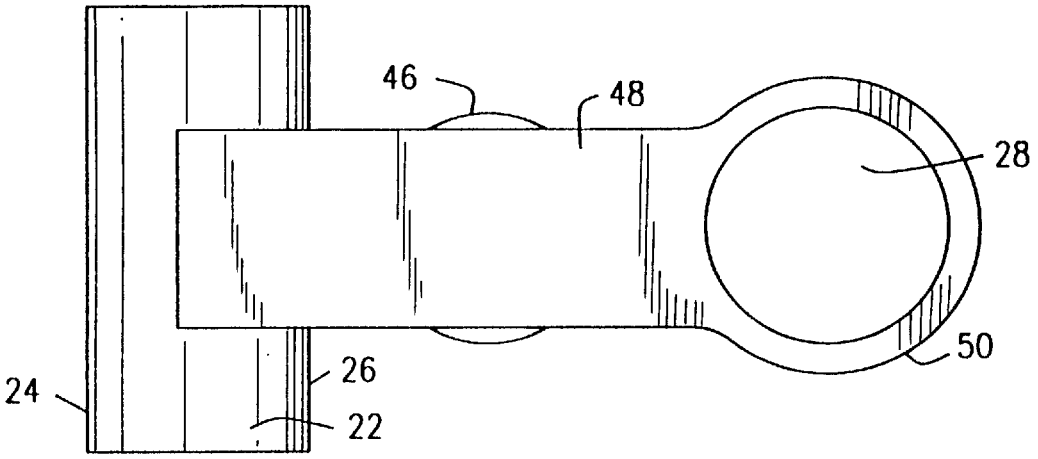
FIG. 3C is a bottom plan view of the clamp portion of the anchoring device shown in FIG. 2.
Figure 3D:
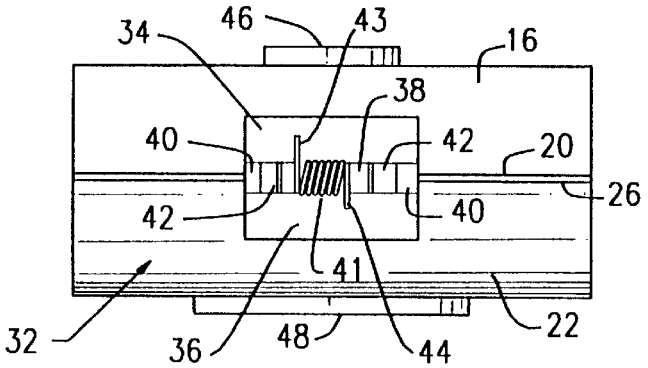
FIG. 3D is a rear view of the clamp portion of the anchoring device portion of the anchoring device shown in FIG. 2.

FIG. 2, depicts a closer view of one of the four devices 10 of the present invention shown in FIG. 1. Each device 10 of the present invention generally comprises two components: a clamp 12 which removably attaches to a corner of the blanket 11; and a spike 14 which is inserted through an eyelet 28 defined therein. The spike 14 is inserted into the sand of the beach to retain the corner of the blanket 11 in place. It is preferable that the clamp 12 and spike 14 both be molded from plastic. However, in other embodiments of the present invention, the clamp 12 and/or spike 14 can be fabricated from other suitable materials such as carbon fibers, fiberglass or metal.

Referring to FIGS. 3A–3D, the clamp 12 consists of a first arcuate jaw member 16 having a gripping end 18 and a coupling end 20, and a second arcuate jaw member 22 having a gripping end 24 and a coupling end 26. The gripping ends 18 and 24 of the jaw members 16 and 22, respectively, each include gripping teeth 30 which enable the clamp 12 to securely engage a corner of the blanket 11. The coupling ends 20 and 26 of the jaw members 16 and 22, respectively, are attached to a conventional hinge arrangement 32 which provides for pivotal movement of the first and second jaw members 16 and 22. The hinge arrangement 32 includes a first hinge plate 34 attached to the coupling end 20 of the first jaw member 16, and a second hinge plate 36 attached to the coupling end 26 of the second jaw member 22. The first and second hinge plates 34 and 36 are pivotally coupled together by a pintle 38 that extends though receptacles 40 and 42 defined on hinge plates 34 and 36, respectively. The pintle 38 also slides through a coil-like spring 41 which includes a first spring tang 43 and a second spring tang 44. The first spring tang 43 abuts against the first hinge plate 34 and the second spring tang 44 abuts against the second hinge plate 36, thereby biasing the gripping ends 18 and 24 of the jaw members 16 and 22, respectively, against each other.

Still referring to FIGS. 3A–3D, the clamp 12 also includes a first lever 46 extending from the first jaw member 16, and a second lever 48 extending from the second jaw member 22. The first and second levers 46 and 48 are provided so that a user can manually grip and open the jaw members 16 and 22 of the clamp 12. As can be seen, the second lever 48 is substantially longer than the first lever 46 and defines the spike receiving eyelet 28 at a free end 50 thereof Referring to FIG. 4A, the spike 14 has a shank 52 extending from an enlarged head portion 54 thereof which allows the spike 14 to be driven into the sand. The shank 52 tapers down to a generally pointed end 56 to allow it to easily penetrate the sand. Barbs 58 or other like gripping projections are provided on an outer surface 60 of the shank 52 to facilitate the spike's grip in the sand. In the preferred embodiment, the shank 52 is hollow and defines an opening 62 at its pointed end 56 to allow sand to enter an interior 64 of the shank 52 when the spike 14 is driven into the sand. This feature increases the spike's lateral stability in the sand and makes it more resistant to being disturbed. It is also contemplated that in other embodiments of the present invention, the shank can be solid. This would be more desirable where the unpaved ground surface is a lawn or other like surface. In still other embodiments of the present invention, it is contemplated that the shank can be hollow but closed at the pointed end to prevent sand from entering the shank.

Figure 4A:
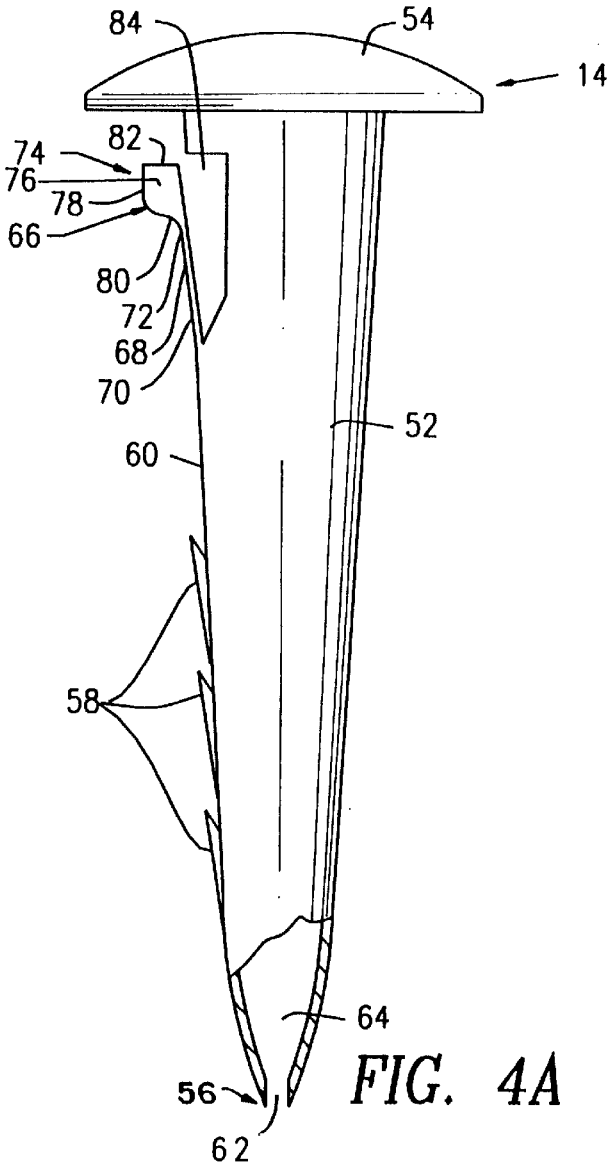
FIG. 4A is a side elevation view of the spike portion of the anchoring device portion of the anchoring device shown in FIG. 2, wherein the locking mechanism is shown in the locked position and the bottom of the shank is shown in cross-section.

Still referring to FIG. 4A, the shank 52 of the spike 14 includes a locking mechanism 66 which is shown in a locked position, wherein the locking mechanism 66 locks the clamp 12 to the spike 14. The locking mechanism 66 includes an elastically deformable link 68 pivotally connected to the shank 52 at its base 70. On an outer surface 72 of the link 68, at an end 74 opposite to the base 70 thereof, is defined a locking tab 76. The locking tab 76 projects from the outer surface 72 of the link 68 and has a face surface 78, a lead-in surface 80 which is inclined relative to the face surface 78 thereof, and an abutment surface 82 which is generally perpendicular to the face surface 78 thereof.

Figure 4B:
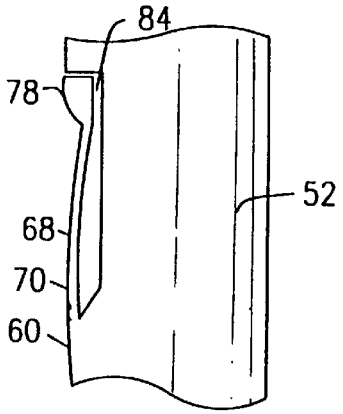
FIG. 4B is a side view of the spike shown in FIG. 4A, wherein the locking mechanism is shown in the unlocked position.

Referring to FIG. 4B, a recess 84 is provided in outer surface 60 of the shank 52 in an area immediately adjacent to the link 68 so that the link 68 can be pivoted at its base 70 into the recess 84 in an unlocked position. The recess 84 has a depth which enables the link 68 to enter therein such that the face surface 78 of the locking tab 76 is flush with the outer surface 60 of the shank 52 in the unlocked position. Accordingly, when the link 68 is held in the unlocked position as shown in FIG. 4B, the shank 52 of the spike 14 can be withdrawn or inserted into the eyelet 28 of the clamp 12. The inclined lead-in surface 80 of the locking tab 76 allows the link 68 to be automatically moved from the locked position to the unlocked position without the need to manually squeeze the link 68 and the shank 52 together. The link 68 is provided with elastic memory so that the link 68 automatically returns to the locked position shown in FIG. 4A when the link 68 is not manually or automatically pivoted into the recess 84.

Figure 5:
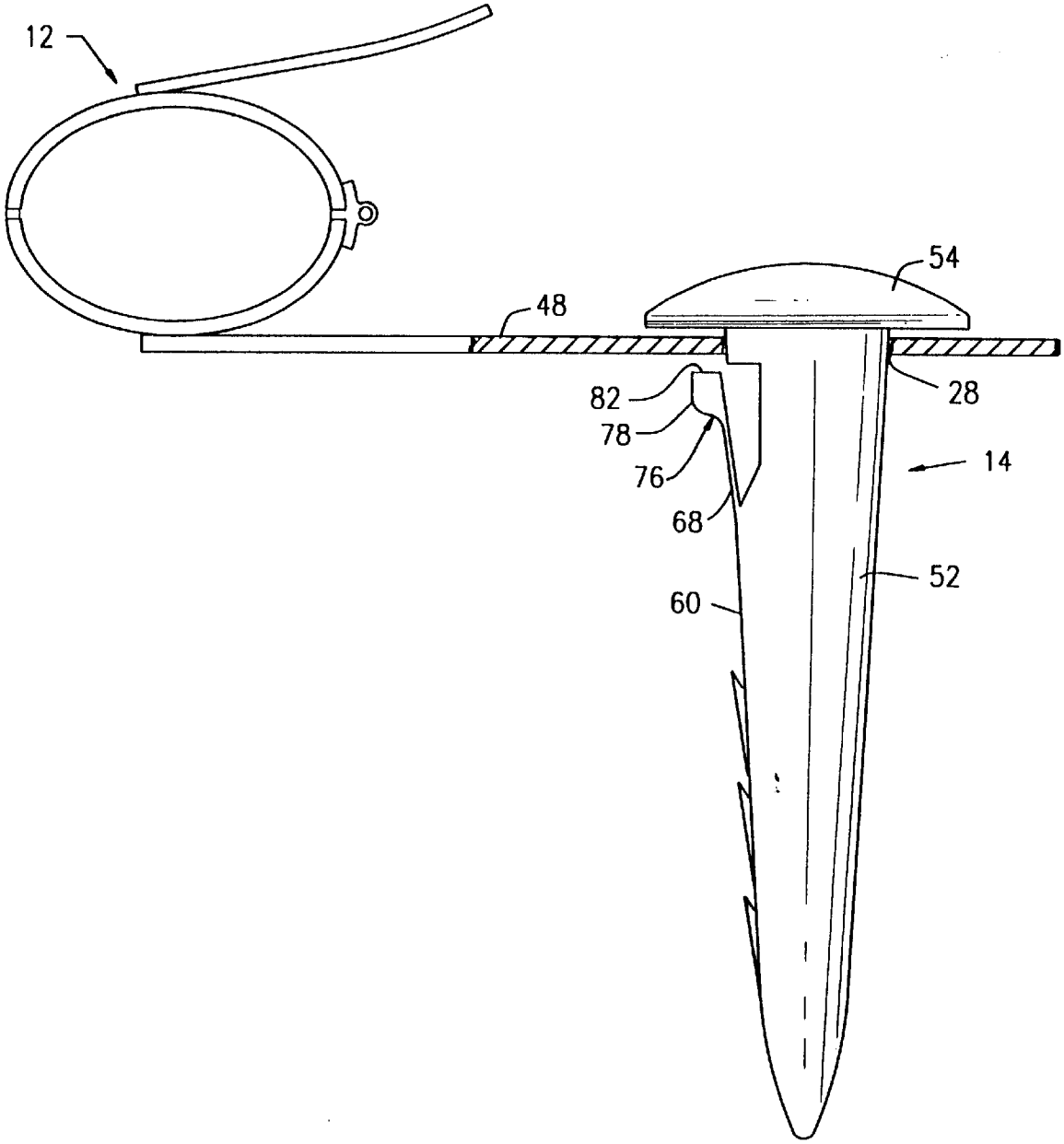
FIG. 5 is a side elevation view of the spike and clamp shown in FIG. 2, wherein the spike is attached to the clamp with the free end of the second lever shown in cross-section.

FIG. 5 shows the spike 14 attached to the clamp 12. As can be seen, the second lever 48 in the area surrounding the eyelet 28 of the clamp 12 is locked between the head portion 54 of the spike 14 and the abutment surface 82 of the locking tab 76 of the spike 14. Thus, the spike 14 remains securely attached to the clamp 12 until the user manually squeezes the link 68 and shank 52 together such that the face surface 78 of the locking tab 76 becomes flush with the outer surface 60 of the shank 52 thereby allowing the shank 52 of the spike 14 to be withdrawn from the eyelet 28 of the clamp 12.

The diameter D of the eyelet 28 is generally the same as the diameter d of the shank 52 in the area immediately adjacent to the head portion 54, which in the preferred embodiment, is approximately 0.75 inches. The preferred length L of the spike 14 is approximately 3.5 inches. It should be understood, that the dimensions of the clamp 12 and spike 14 can be adjusted to suit the desired application.

Figure 6:
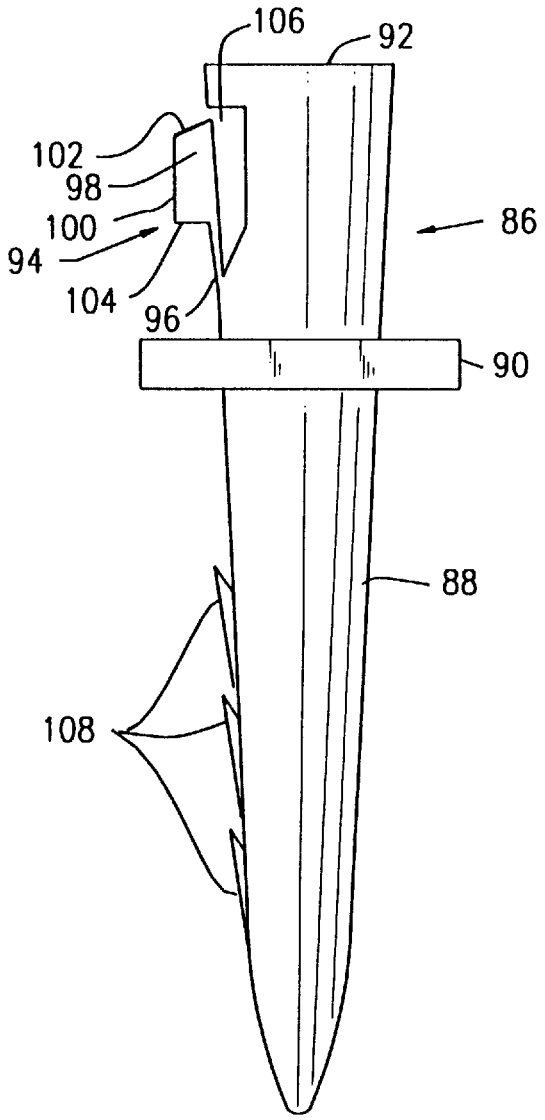
FIG. 6 is a side elevation view of a second embodiment of the spike.

FIG. 6 depicts another embodiment of a spike 86 according to the present invention. As shown, the spike 86 includes a shank 88 having an outwardly extending circumferential flange 90 located marginally adjacent to a top end 92 of the shank 88. The spike 86 also includes barbs 108. A locking mechanism 94 is located on the shank 88 between the top end 92 and the circumferential flange 90. Like the locking mechanism of the previously described embodiment, the locking mechanism 94 of this embodiment of the spike 86 includes an elastically deformable link 96 which is pivotally connected to the shank 88 at its base 98. The link 96 includes a locking tab 98 having a face surface 100, a lead-in surface 102 which is inclined relative to the face surface 100 thereof, and an abutment surface 104 which is generally perpendicular to the face surface 100 thereof. A recess 106 is provided in the shank 88 immediately adjacent to the link 96 for pivotally receiving the link 96 in the manner described above in the previous embodiment of the spike. The inclined lead-in surface 102 of the locking tab 98 facilitates insertion of the spike 86 in the eyelet 28 of the clamp 12. The link 96 is provided with elastic memory so that the link 96 automatically returns to the locked position when not manually or automatically pivoted into the recess 106. An advantage of this embodiment of the spike 86, is that the clamp 12 can be removed from the spike 86 without having to remove the spike 86 from the sand. This allows the beach blanket 11 to be removed from the beach and shaken out, changed or the like, and then re-anchored without having to reinstall the spikes in the sand.

Although the present invention is principally intended to secure a beach towel to a beach, the clamp portion of this invention can also be used to secure a towel and the like to the back of a chair, as well as to secure a tablecloth to a table.

Accordingly, numerous modifications and alternative embodiments of the present invention will be apparent to those skilled in the art in view of the foregoing description. Hence, this description is to be construed as illustrative only and is for the purpose of teaching those skilled in the art the best mode of carrying out the invention. Details of the structure may be varied substantially without departing from the spirit of the invention and the exclusive use of all modifications which come within the scope of the appended claims is reserved.

What is claimed is:

1. An anchoring device comprising:

spike means and clamp means for coupling an object to be anchored to said spike means, said clamp means including an eyelet for receiving said spike means to couple said clamp means to said spike means;

said spike means including disengageable lock means for preventing withdrawal of said spike means from said eyelet when said lock means is engaged and allowing withdrawal of said spike means from said eyelet when said lock means is disengaged.

2. A beach blanket anchoring device comprising:

a spike for inserting into sand and a clamp for coupling a beach blanket to said spike, said clamp including an eyelet for receiving said spike to couple said clamp to said spike;

said spike including a disengageable lock for preventing withdrawal of said spike from said eyelet when said lock is engaged and allowing withdrawal of said spike from said eyelet when said lock is disengaged.

3. The device according to claim 1, wherein said clamp means further includes a pair of pivotally coupled jaw members and spring means for biasing said jaw members together, said eyelet extending from one of said jaw members.

4. The device according to claim 3, wherein said clamp means further comprise a finger lever coupled to one of said jaw members for spreading apart said jaw members.

5. The device according to claim 1, wherein said spike means includes barb means.

6. The device according to claim 2, wherein said clamp further comprises a pair of pivotally coupled jaw members and a spring for biasing said jaw members together, said eyelet extending from one of said jaw members.

7. The device according to claim 6, wherein said clamp further comprises a finger lever coupled to the other one of said jaw members for spreading apart said jaw members.

8. The device according to claim 2, wherein said lock includes a resiliently biased elongated member attached at one end to said spike.

9. The device according to claim 2, wherein said spike includes a plurality of barbs for preventing removal of said spike from the sand.

10. The device according to claim 2, wherein said spike is hollow.

11. The device according to claim 10, wherein said spike is open at one end.

12. The device according to claim 2, wherein said spike is solid.

13. The device according to claim 2, wherein said spike comprises a shank and a head portion at one end thereof.

14. The device according to claim 2, wherein said spike comprises a shank and circumferential flange extending from said shank.

* * * * *